US005616110A

United States Patent [19]

Nascimento

[11] Patent Number: 5,616,110

[45] Date of Patent: Apr. 1, 1997

[54] DEVICE FOR MUSCULAR ELONGATION, FLEXION AND PHYSIOTHERAPY

[76] Inventor: Isaías B. D. Nascimento, Rua Marechal Floriano, no. 319, Centro MG, Brazil

[21] Appl. No.: 464,890

[22] PCT Filed: Nov. 30, 1993

[86] PCT No.: PCT/BR93/00043

§ 371 Date: Jun. 28, 1995

§ 102(e) Date: Jun. 28, 1995

[87] PCT Pub. No.: WO94/14505

PCT Pub. Date: Jul. 7, 1994

[30] Foreign Application Priority Data

Dec. 29, 1992 [BR] Brazil ..... 9205222

[51] Int. Cl.[6] ..... A63B 21/00

[52] U.S. Cl. ..... 482/131; 482/907; 601/24; 601/35

[58] Field of Search ..... 482/95, 96, 123, 482/125, 131–134, 139, 148, 907, 908; 601/23, 24, 33–35; 606/241

[56] References Cited

U.S. PATENT DOCUMENTS

| | | | |
|---|---|---|---|
| 4,089,330 | 5/1978 | Nicolosi et al. . | |
| 4,445,684 | 5/1984 | Ruff . | |
| 4,647,040 | 3/1987 | Ehrenfrud | 482/131 |
| 4,819,936 | 4/1989 | Muller | 482/907 |
| 4,844,453 | 7/1989 | Hestilow . | |
| 4,877,239 | 10/1989 | Dela Rosa | 482/907 |
| 4,921,242 | 5/1990 | Watterson | 482/121 |
| 5,277,681 | 1/1994 | Holt . | |
| 5,277,684 | 1/1994 | Harris | 482/908 |

FOREIGN PATENT DOCUMENTS

| | | | |
|---|---|---|---|
| 267757 | 5/1994 | France | 482/148 |
| 220034 | 3/1910 | Germany | 482/907 |

*Primary Examiner*—Richard J. Apley
*Assistant Examiner*—Jeanne M. Clark
*Attorney, Agent, or Firm*—Beveridge, DeGrandi, Weilacher & Young, L.L.P.

[57] ABSTRACT

The present device, which includes four accessories, incorporates in one machine that which is required for the elongation of muscles in all parts of the body, namely: the static, the dynamic, and the 3s or PNF Methods. The device consists of a main frame (1), a seat with a back (2) mounted on the frame's upper surface, two lateral foot supports (3), and a rolling car (13), which when pulled, operates a load-reducing mechanism (18) which includes two pulleys (7) connected to two supports (5), which open laterally or sidewise, and carry with them two supports (3). Each foot support (3) is equipped with hand grips (12). The accessories include two additional foot supports (29, 33) attachable to the car (13), two modules (35) fitted laterally into the frame (1) and used to support the legs when bent or flexed, and a support accessory connected to the frame (1) through the supporting column (43).

15 Claims, 3 Drawing Sheets

DEVICE FOR MUSCULAR ELONGATION, FLEXION AND PHYSIOTHERAPY

Figure 1:
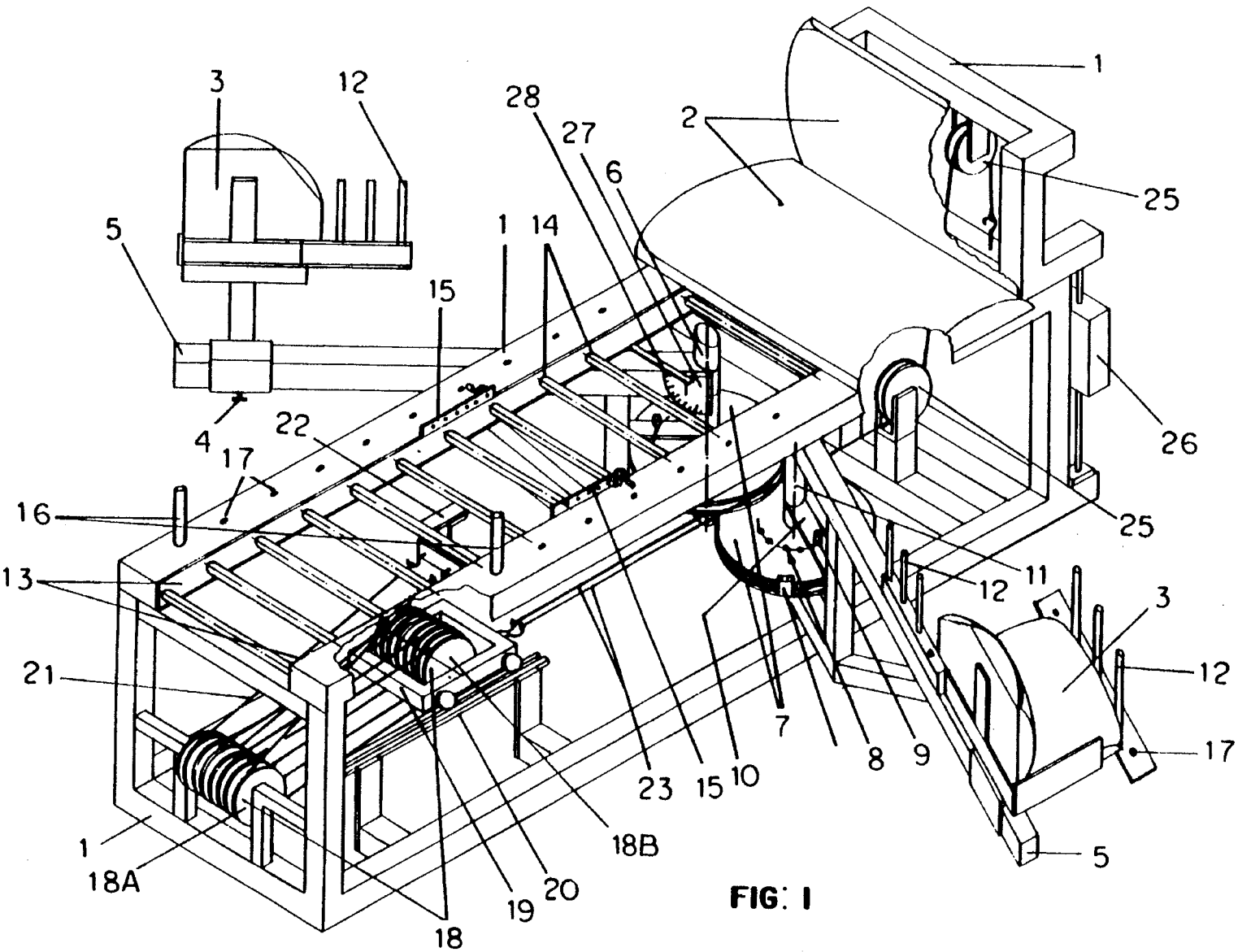

The present invention relates to a device which enables the achievement of extending various muscles of the human body, through all of the means known for muscular elongation, as follows: STATIC (without movement), DYNAMIC or BALLISTIC (with motion), and the 3s or PNF METHOD.

At the present time, the devices existing for muscular elongation do not satisfy the requirements of the user, inasmuch as they only operate on isolated groups of muscles, using only one type of elongation, namely the STATIC, thus making further progress impossible. In addition to the face that they require excessive and onerous effort, inasmuch as they generally are activated by a cranking mechanism, they limit the movements of the user, so that the latter, not having any point of support or place of attachment, to maintain his balance or to extend his other muscles, has no options with regard to other types of exercise. This being so, outside help is almost always required to assist the user in achieving the range of motion.

The present invention has been developed with the aim in mind of solving all of the problems mentioned above, the main objective being to make it possible for the user to fully use and apply to all parts of his body exercises for muscular elongation and muscular flexion, through gentle, safe, and smooth movements. When appropriately positioned, the user will obtain perfect harmony of the leg and thigh muscles, the spinal column being unhindered and protected, without risk of muscular twisting or strains. Moreover, the device is able to block the internal leg muscles, once having been extended to the limits of their flexibility, thus inducing relaxation of other muscles used in executing movements; thus they are not unduly stretched, and most importantly, avoid stress on the spinal column. In addition to providing for the harmonious functioning and easement of the body, the device is easily operated, providing support for the hands in all positions of operation. Thus the device allows for harmonious and progressive exercises, facilitating conditions for rhythmic and controlled breathing, which are so necessary in elongation exercises.

The device consists of a structure upon which a movable car operates. When this is pulled it activates two leg supports, which open to form an angle of 180 degrees, the effort required being sufficiently diminished by a load reducing mechanism. The device makes possible gentle and rhythmic movements of the body. These result in the simultaneous elongation of the inside thigh muscles, as well as those of the back, shoulders, arms and hands, by means of all the types of muscular elongation heretofore specified. When the car is pulled the inside muscles of the legs (thighs, knees, calves and feet) and when the legs are drawn together all of the muscles of the back, trunk, shoulders, arms and hands are extended, the latter gripping the parallel bars of the car. The effort required to move the car is greatly reduced by the load reducing mechanism, both in the case when the car is being pulled, as well as when the leg supports are being pulled together, thus protecting the spinal column. The simultaneous elongation of the leg and back muscles, as well as those of the back, arms, and hands may also be effected using the 3S or PNF method, which consists of a three-mode operation: 1) simple elongation, 2) contraction without muscle motion, and 3) relaxation, yielding greater results than those hitherto described. This method is most effective with respect to the development of flexibility, which is defined as the range of voluntary movement of a joint, or combination of joints in any determined direction. It helps muscular elasticity and permits a more ample range of motion for the different parts of the body. Muscular elongation, on the contrary, is characterized by half the range of muscle motion. The 3S or PNF method is widely used in physiotherapy exercises in cases of distension and contraction of the muscles.

The invention may better be described by the following detailed explanation together with the attached drawings, as follows:

FIG. 1, shows an overall view of the device, in perspective.

Figure 2:
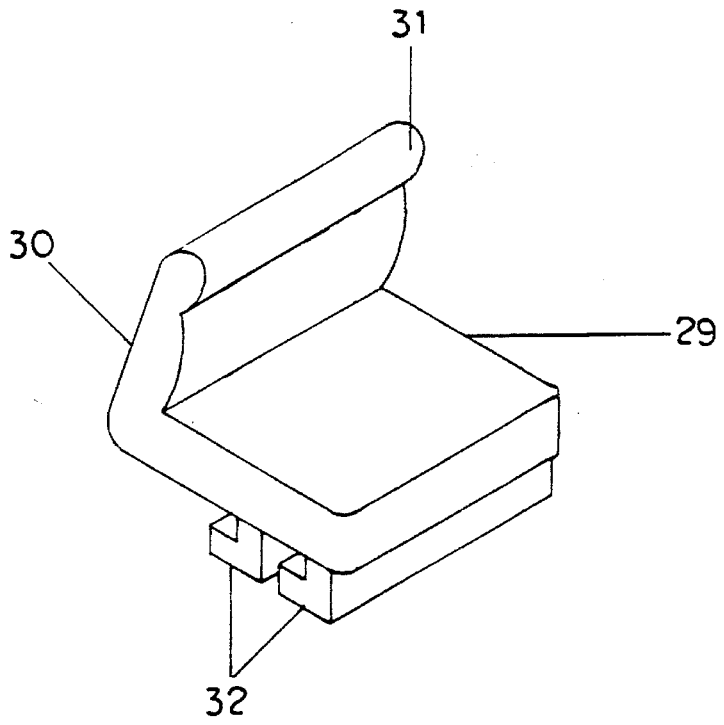

FIG. 2, also in perspective shows an overall view of an auxiliary accessory used in extensions of the leg calf, the Achilles heel, and of the back of the thighs.

Figure 3:
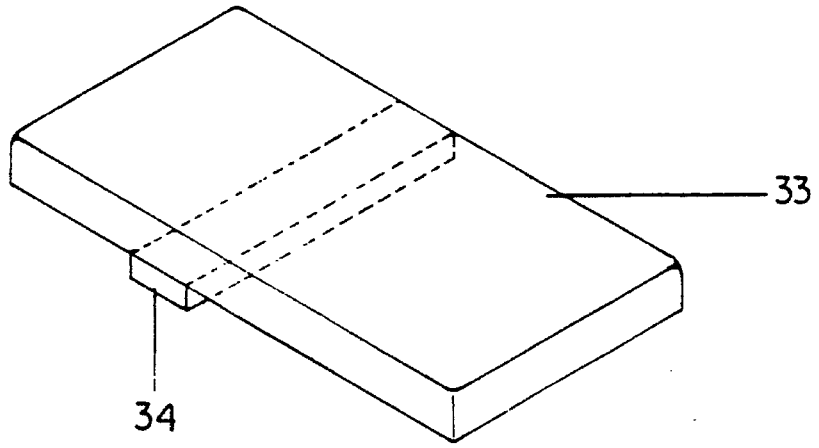

FIG. 3, in perspective, shows an overall view of an accessory used in extending the inside muscles of the leg, trunk, arms and hands.

Figure 4:
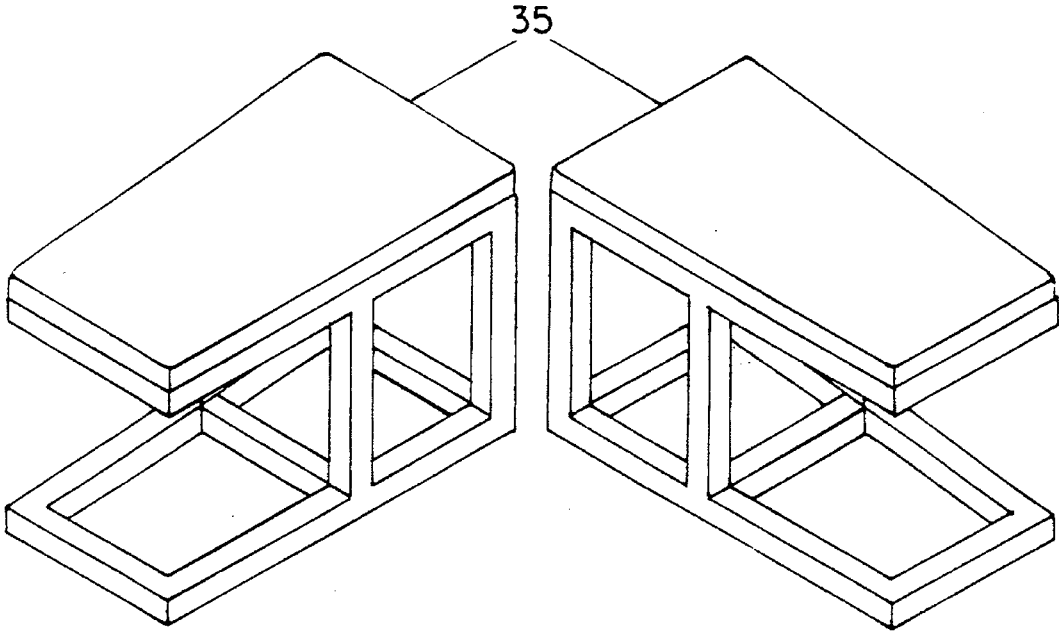

FIG. 4, in perspective, shows an overall view of the accessory used to lengthen the top leg muscles and those of the top of the foot.

Figure 5:
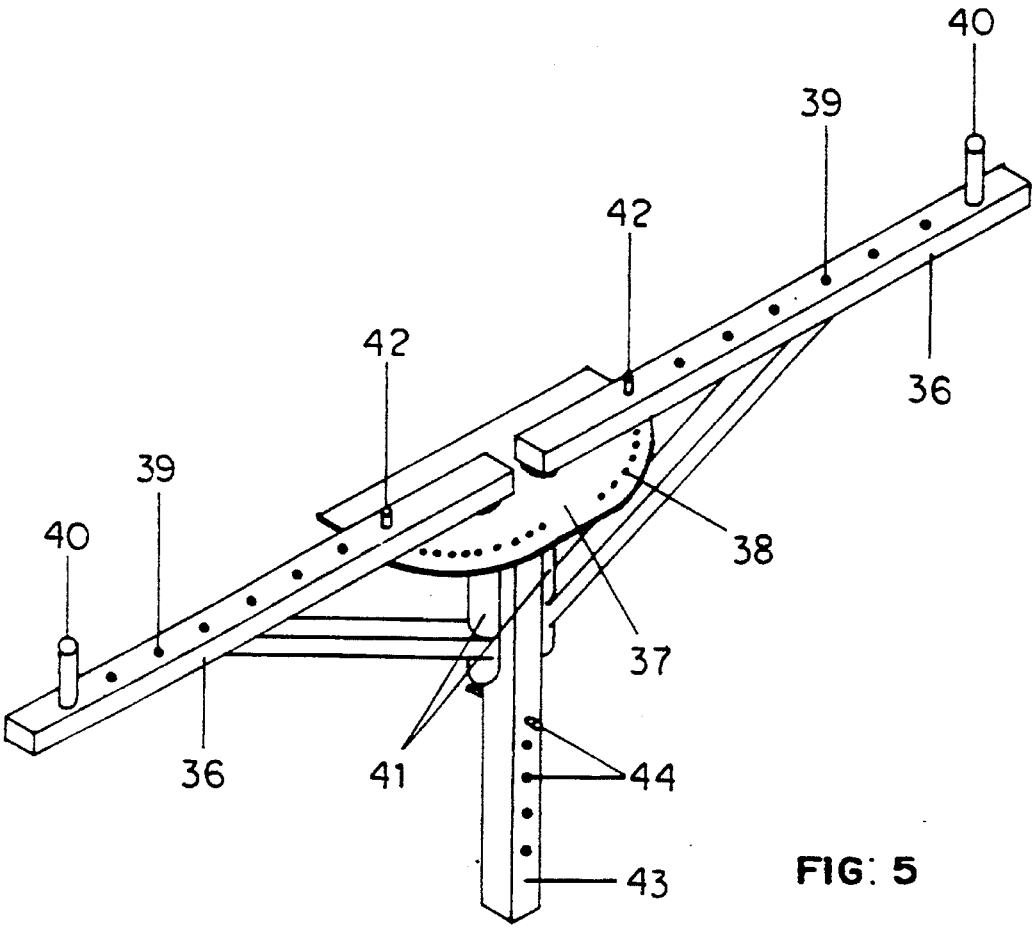

FIG. 5, in perspective, shows an overall view of the accessory used to lengthen the front trunk muscles (the pectoral muscles), the shoulders, arms, and hands.

With reference to FIG. 1, the upper surface of the device is equipped with a seat (2), with a back and two lateral foot supports (3), all being on the same level, and is equipped with longitudinally adjustable stops (4) allowing adjustments of supports (5). The latter are connected to two rotating axles (6), which operate parallel to each other, and vertically fastened to frame (1), where they are connected to two pulleys (7), containing perforation (8) in such a way that they allow for positioning of the supports (5) which are adjustable from the inside outwards, or in other words laterally. These adjustments vary from zero to ninety degrees for each pulley (7), which makes it possible to open the supports (3) to form an angle of one hundred and eighty degrees. In order to make an adjustment, one pin (9) is inserted into plate (10) in such a way that the perforation coincides with the perforations (8) of the pulleys (7). The supports (5) are held in place and pinned to the pulleys (7) in this way. Plate (10) connects each support (5) to another rotating tube (11) which turns freely around each axle (6). Inasmuch as the two supports (5) rotate independently of each other and also of the pulleys (7) it will be seen that each support (5) can be set to the desired angle, allowing each support (3) to be set and fixed to any position desired. For each support (3) there are parallel vertical bars (12) which serve as hand grips. Bars (12) may be fixed or movable, and are located near the supports (3). Moreover, the upper part of the structure (1) is equipped with a sliding car (13) which is free to move in a longitudinal direction between the two extremities of the long axis of the device, and runs under the seat (2) towards the rear end of the structure (1). This car (13) serves as a lever and is propelled by means of horizontal parallel bars (14); it may be blocked at any position of its course by means of blocking device (15). The upper part of the frame (1) is equipped with auxiliary and movable hand grips (16), which can be set to the desired position by inserting them into the orifices or perforations (17) running the length of the upper surface of the frame (1). On the inside of the frame (1) there is a load-reducing mechanism (18) for reducing the load, consisting of two groups of "n" pulleys which, independently, turn on two axles. The first group of pulleys (18-A) operates with its axle fixed to the frame (1). The second group (18-B) has its axle fixed to a movable car (19) which runs on rails (20). A single cable (21) connects all of the pulleys of the mechanism (18), interconnecting both groups (18-A and 18-B); one end of the cable is attached to support (22), connected to the bars (14) of the car (13). From there the cable is threaded through the mechanism (18), returning to support (22), where the other end of the cable is attached. Two other cables (23), the ends of which are fixed to car (19), begin at the car and make a complete turn around each pulley (7) from whence each cable is duly fixed (to avoid slippage) by a blocking mechanism (24). These cables then pass through a group of pulleys (25) serving as guides. The other ends of the cables are attached to a counterweight (26) or spring, the purpose of which is to close brackets (5) and to keep the cables (23) taut. Moreover, the device is equipped with two instruments (27) for measuring angles permitting variable settings. Each measuring instrument is attached to a bracket (5), and as the latter opens, the instrument accompanies it. The initial starting point is set at zero degrees and the final position at 90 degrees. The indication of the angle is made by pointer (28) attached to the frame (1).

IN order to demonstrate the utility of the invention some exercises are listed below.

The user seats himself/herself comfortably on seat (1), with the legs resting on the lateral supports (3), pushing the rolling car (13), with the spinal column maintained in an erect position, and the supports open, laterally stretching the leg muscles. Once the desired degree of opening is achieved, the blocking device (15) is activated, stopping the car (13). In this manner the hands are free and the muscles of the trunk may be stretched by bending frontwards over the car, and gripping the bars (14) or the auxiliary supports (16). If lateral elongation or stretching is desired, the same procedure is followed, by bending towards and over each leg, in the direction of the feet, using the parallel vertical bars (12) attached to the supports (3) as hand grips. When a sufficient amount of muscular elongation is obtained, the car (13) is unblocked and it is again pushed forward. In this way increasing the angle formed laterally by the spreading of the legs. Once the car has been fixed in place, all of the motions for elongating the muscles of the trunk are repeated. This procedure is followed sequentially. Inasmuch as the hand grips may be set to correspond to all the positions of the device, the range and variety of possible exercises is great. This is so because muscular elongation can take place with greater assuredness and balance, allowing the body to be bent in any direction, which involves the stretching of the muscles relating to the motions. To cite an example: when the trunk is stretched by bending frontwards or in the direction of either of the legs, laterally, all of the rear muscles of the legs and trunk will be naturally elongated.

FIG. 2 includes a horizontal support (29) coupled to a vertical support (30) at the extremity of which is a protuberance (31). There is a joint (32) at the lower end of the horizontal support (29) which is attached to the parallel bars (14) of the car (13). In order to exercise, the foot of the user rests on protuberance (31) and his heel rests on the lower part of the vertical support (30) and at the same time on the horizontal support (29). As the trunk is projected or bent forward, using the hand grips (16) for the hands, the user being duly seated on seat (2), the back part of the leg muscles will be extended, chiefly in the area of the calves and the Achilles heel inasmuch as the foot will be half bent or flexed due to the fact that it will be at a lower angle than the heel, in this way inducing a greater amount of stretching.

FIG. 3 includes a support (33) with a joint or coupling (34) which is attached to the parallel bars (14) of the car (13).

This accessory is used when performing what is known as the "butterfly" stretch. The soles of the feet rest on support (33), the user is duly seated on the seat (2) and in this way the front and inside muscles of the thighs and knees may be extended. When the body is thrown forward using the hand grips (16), the muscles mentioned above will be further stretched as well as affecting the muscles of the back, shoulders, arms and hands.

FIG. 4 includes two modules (35) which are each attached to the sides of the frame (1) adjacent to seat (2). These modules (35) may be adjusted longitudinally with reference to the frame (1). They serve to support the legs when stretched, the positioning of which makes it possible to lengthen the top muscles of the legs and the back or top of the feet. Examples of some exercises: The user, properly positioned on seat (2), flexes one or both of his legs, on modules (35). The other leg, may remain extended, resting the foot on the accessory (FIG. 2) or bent over the accessory (FIG. 3). This allows for muscle stretching by throwing the body forward, using the hands grips (16), or by making sideways turning movements. Such motions are assisted by hand grips (12), when positioned near the foot supports (3). In order for this to take place, supports (5) must be disconnected from the pulleys (7). Since supports (5) are free to move, the hand grips (12) come into play; the trunk is rotated until it touches the leg bent over one of the modules (35); in this way all of the lateral trunk muscles, the shoulder, arm, hand, thigh and foot muscles will be stretched.

FIG. 5 includes two supports (36) which move along a disc (37). When they are in the closed position, they lie at the center of the disc, but they may be opened. These supports (36) are adjustable for angles from 0 a 90 degrees each. The disc (37) is perforated with holes (38) for fixing supports (36) which also have perforations (39) for attaching hand grips (40), which are adjustable longitudinally along supports (36). The latter are coupled to two rotating axles (41), also attached to disc (37). The adjustment and attachment of the supports (36) to the disc (37) is made possible by attachment pins (42) which fit into the perforations (38). Disc (37) is coupled to column (43), which is also attached to frame (1), back of the seat back (2); they may be vertically adjusted by means of joint (44).

This accessory is used for the STATIC elongation of the front muscles of the thorax (the chest muscles), as well as for the muscles of the shoulders, arms, and hands.

We give examples of some exercises: The user is positioned on seat (2), using the two hand grips (40), having duly adjusted the supports (36) for the angle desired. In this way, all of the muscles referred to above are stretched, with the sides duly protected by the seat back (2); this allows for relaxation followed by progressive and further stretching. When a satisfactory amount of elongation has been achieved, the whole process is repeated by again adjusting the supports (36) to the angle desired, so that they meet together at the center of the disc (37).

Another variation of this exercise consists in the lateral or sidewise stretching of the legs, which have been duly block-positioned; the entire sequence of operations referred to above is then repeated. Satisfactory stretching, muscle flexing and physiotherapeutic applications are achieved by the use of a great number of exercises with the aid of the accessories.

I claim:

1. Mechanical device for muscular elongation, muscular flexion and physiotherapy having a frame having a longitudinal direction, a seat fixedly associated with said frame and first and second lateral leg support means arranged on each side of said frame which respect to said longitudinal direction, each said leg support means being mounted to be swung outwardly from said frame in a substantially horizontal plane, away from an initial position of repose, characterised by comprising:

(a) a carriage mounted for movement on said frame in said longitudinal direction, towards and away from said seat;

(b) hand grips on said carriage to permit a user seated on said seat to pull the carriage towards said seat;

(c) force applying means for biasing said first and second leg support means towards said position of repose;

(d) mechanical non-motorised load reducing means for transmitting linear movement of said carriage from a force input to a load input, the force input being connected to said carriage, (e) transformation means connected between said load input and said leg support means, for transforming said linear movement at said load input into swinging movement of said leg support means, whereby said load reducing means reduces the force required at said hand grips to move the carriage against a load represented by the combination of the force applying means and the resistance due to the legs of the user on said leg support means; and (f) carriage blocking means for blocking the movement of said carriage in at least one selected position with respect to said frame.

2. Mechanism device according to claim 1, characterised by further comprising:

(g) means for adjusting the initial outward angle of each said leg support means with respect to said longitudinal direction in said position of repose.

3. Mechanical device according to claim 2, characterised in that said means for adjusting said initial outward angle comprise first and second independently adjustable means to permit the first and second leg support means to have different preselected initial outward angles in said position of repose.

4. Mechanical device according to claim 1, characterised in that said load reducing means comprise a first pulley block fixed with respect to said frame, a second pulley block mounted to permit movement thereof towards and away from said first pulley block, and first cable sequentially passed around the pulleys of said first and second blocks and having its ends fixed at said force input.

5. Mechanical device according to claim 4, characterised in that said transformation means comprise second and third cables each having one end fixed at said load input to said second pulley block, and respective first and second leg support pulleys arranged to transmit said linear movement at said load input to said swinging movement of said respective first and second leg support means.

6. Mechanical device according to claim 5, characterised in that each said leg support means comprises an elongate leg bar, a foot support in the region of an outer end of the leg bar, said leg bar being rotatable about an axis of rotation common to that of the respective leg support pulley, and selective blocking means to cause said leg support pulley and the respective leg bar to rotate together with the leg support at the respective said preselected initial outward angle.

7. Mechanical device according to claim 1, characterised in that said carriage is provided along its length with a plurality of means for receiving said hand grips at preselected positions.

8. Mechanical device according to claim 5, characterised in that said force applying means comprise means for applying a rotary force to said first and second leg support pulleys in a rotary direction opposite to that transmitted thereto by said second pulley block.

9. Mechanical device according to claim 8, characterised in that said force applying means comprise continuations, from said leg support pulleys, of said second and third cables, the free ends of said cable continuations supporting a counterweight or being maintained taut by a spring.

10. Mechanical device according to claim 1, characterised in that said carriage blocking means are arranged to block the movement of said carriage in a plurality of selected positions with respect to said frame.

11. Mechanical device according to claim 1, characterised by comprising angle indicator means to indicate the angle which said leg support means are swung away from said frame.

12. Mechanical device according to claim 1, characterised by further comprising a removable additional foot support component having a horizontal portion and an upstanding portion, said horizontal portion being adjustable to the upper side of said carriage at preselected positions in said longitudinal direction, and the edge of said upstanding portion remote from and parallel to said horizontal portion being formed with a protuberance.

13. Mechanical device according to claim 1, characterised by further comprising a removable substantially planar foot support component adapted for attachment to the upper side of said carriage to permit the user to execute "butterfly" stretch exercises.

14. Mechanical device according to claim 1, characterised by further comprising two removable lateral leg support modules adaptable to the sides of said frame to permit the execution of additional exercises.

15. Mechanical device according to claim 1, characterised by further comprising an arm support module including two horizontal support bars provided with suitable handgrip attachment means for the attachment of handgrips at preselected positions along their upper surfaces, first ends of said arms being adjacent to each other centrally of said module, each said arm being rotatable about a vertical axis and provided with means for locking it in a selected one of a plurality of angular positions in a horizontal plane.

* * * * *